United States Patent [19]

Diamond et al.

[11] Patent Number: 4,891,059

[45] Date of Patent: Jan. 2, 1990

[54] PHASE REDISTRIBUTION PROCESSING

[75] Inventors: Sidney Diamond, Dublin; Aspi N. Patel, Columbus, both of Ohio

[73] Assignee: Battelle Development Corporation, Columbus, Ohio

[21] Appl. No.: 238,959

[22] Filed: Aug. 29, 1988

[51] Int. Cl.[4] ..... B21B 1/46; C22C 1/04

[52] U.S. Cl. ..... 75/0.5 R; 75/0.5 B; 148/902; 420/590

[58] Field of Search ..... 75/0.5 B, 0.5 R; 148/902; 420/590

[56] References Cited

U.S. PATENT DOCUMENTS

| | | | |
|---|---|---|---|
| 3,528,806 | 9/1970 | Beghi et al. | 75/0.5 B |
| 4,264,354 | 4/1981 | Cheetham | 75/0.5 B |
| 4,404,023 | 9/1983 | Glück | 75/0.5 B |
| 4,579,587 | 4/1986 | Grant et al. | 75/0.5 R |
| 4,668,282 | 5/1987 | Gilman et al. | 75/0.5 B |
| 4,702,765 | 10/1987 | Sato | 75/0.5 B |
| 4,715,893 | 12/1987 | Skinner et al. | 75/0.5 R |

*Primary Examiner*—Upendra Roy

*Attorney, Agent, or Firm*—Barry S. Bissell

[57] ABSTRACT

Homogeneous and refined microstructure powders and the method of making them from, for example, liquid metal immiscible systems or very limited solid solubility systems. At least two metals are melted and then rapidly solidified to yield a solid with a segregated, non-uniform microstructure. The resulting rapidly-solidified solid is then reduced to a powder and subjected to high-energy milling for a time sufficient to reduce the segregation to the desired level of uniformity.

9 Claims, No Drawings

PHASE REDISTRIBUTION PROCESSING

TECHNICAL FIELD

Mechanical properties of alloys can be controlled and optimized by manipulating the size, shape and dispersion of the second phase within the alloy. This is a major reason for research into all areas of metallurgy and metal processing, including two areas in particular, rapid solidification and mechanical alloying.

Rapid solidification is a rapid cooling of liquids which preserves high temperature metastable structures and/or the formation of non-equilibrium phases in the resulting solid material which would otherwise not form during conventional melting and casting. However, some systems such as immiscible alloys may not develop suitably refined microstructure and uniform second-phase dispersions even after rapid solidification. This may be especially true in systems which have a high concentration of the second phase.

Mechanical alloying (MA) is known as a solid state process, carried out in a high-energy ball mill, of repeated cold welding and fracture of a particle mixture of two or more materials. It permits the "cold alloying" of two or more elements or the dispersion of insoluble phases in a ductile, metal matrix. The raw materials for the process generally comprise soft, single phase materials, in particular elemental metals or master alloys, such as shown in John Benjamin's work, eg. U.S. Pat. No. 3,591,362. But the MA process has been heretofore limited to the incorporation of a harder material in a relatively softer matrix and requires the use of surfactants or process control agents to help balance the welding and fracture mechanism of the elemental materials.

U.S. Pat. No. 4,579,587 (Grant) teaches melting a ductile metal alloy, rapidly solidifying it to form a homogeneous metal powder, physically flattening the powder into flake by milling and then dispersing a refractory oxide particle phase in the flake by high-energy milling. Unfortunately, there are many systems which do not yield homogenous powders even when rapidly solidified.

SUMMARY OF THE INVENTION

It is an object of the invention to provide a process for making powder and improved products therefrom.

It is a further object of the invention to provide a process for making powders having uniform and refined microstructures.

It is also an object of the invention to provide a process for making such powders from metals which ordinarily do not form homogeneous structures upon solidification from the melt.

It is also an object of the invention to provide a process for making such powders from metals which ordinarily do not form homogeneous structures by mechanical alloying of their elements.

In accordance with the objectives, the invention is a process for making powder by the steps of providing a molten mixture of at least two metals which, upon rapid solidification, form a solid having segregated phases and a non-uniform microstructure, rapidly solidifying the molten mixture to such a solid having segregated phases and a non-uniform microstructure, reducing the solid to a blendable particle size, and redistributing the solid phases to produce a homogeneous and refined microstructure by high-energy solid state blending.

The process is particularly useful for making powder from metals which are immiscible in the liquid state or those which show very limited solid solubility. Melting spinning, melt extraction and rapid spinning cup are preferred rapid solidification processes. Particles produced by water or gas atomization can also be used as pre-alloyed feedstock. High-energy milling with a ball mill having internal impellers is a preferred phase redistribution method. The method is also very useful in making powders from two soft materials such as lead and copper or lead and tin or for incorporating a soft material in a relatively harder matrix.

DESCRIPTION OF THE PREFERRED EMBODIMENTS

Research has shown that the addition of certain alloying ingredients can improve properties of the matrix metal or alloy. Adding a minor amount of a second metal can increase strength, hardness, corrosion resistance or many other desirable properties. The effect of the additive on a particular property may continue at higher levels. But frequently, the amount of the additive is limited to a low level by a drastic decrease in another important property at higher additive levels caused by the appearance of an additive-rich second phase in the equilibrium structure of the solidified product. Depending on the composition, the second phase may precipitate in the matrix grains or at grain boundaries and may be a pure metal or a compound.

The second phase, of course, results from the insolubility of the second element in the matrix material. Upon slow solidification, the primary phase crystallizes while rejecting the insoluble elements to the remaining liquid. Rapid solidification attempts to prevent the structural changes which occur during slow cooling by freezing a non-equilibrium (high temperature) structure in the casting.

But even rapid solidification at very high cooling rates (eg. $10^{6}$° C./sec) is not always effective to create a homogeneous microstructure. The amount of segregation varies with the rate of cooling, but all systems do not show the same segregation at a fixed rate of cooling. And, obviously, the same degree of segregation in two different compositions may result in grossly different properties. In some compositions a ½ volume percent second phase can be catastrophic, whereas in other compositions 2% may be tolerable. Most segregated systems, particularly those with heavy grain boundary segregated precipitates, tend to show brittle behavior.

The present invention recognizes that the homogeneous incorporation of large amounts of an otherwise insoluble additive may be effective in increasing a desired property without harming another property. The invention also recognizes that the best way to initially increase the amount of an additive in the primary phase and to finely disperse the second phase may be to rapidly solidify the material. Finally, the invention recognizes that the segregated, concentrated phases of the rapidly solidified material can be redistributed in a uniform, homogeneous, fine-grained structure by high-energy fracture and rewelding analogous to present mechanical alloying processes employing elemental metals. For example, it has been found that conventionally cast cuprous materials can incorporate up to about 1% (by weight) Cr before becoming brittle. Rapidly solidified material can incorporate about 5–10% Cr before becoming brittle. But by rapidly solidifying a batch and redistributing the resulting phases by high-energy milling, a second phase of greater than 10% Cr may still produce a ductile alloy.

But unlike classic "mechanical alloying" which has been limited to incorporating a harder material in a softer matrix, the present invention can be used to redistribute a hard material in a hard matrix, a soft material in a soft matrix and even a soft material in a hard matrix. Soft metals or hard intermetallics can also be used interchangeably as the matrix or the minor phase. A copper-30% lead batch during high energy milling can coat the balls and clog the mill if mechanical alloying is tried on the elements. However, a Cu-30% Pb batch can be rapidly solidified to produce a segregated microstructure of uniform Cu grains with about 5% Pb distributed within the grains and the remainder of the Pb segregated in the grain boundaries. Subsequent high-energy milling of this segregated material can produce a homogeneous, refined structure of Cu-30% Pb.

Even with materials which could be "mechanically alloyed", the initial step of rapid solidification drastically reduces milling times required to produce a homogeneous microstructure. An order of magnitude longer time for mechanical alloying in contrast to the high-energy phase redistribution of the present invention is common.

The inventive process for making powder includes the steps of providing a molten mixture of at least two metals, rapidly solidifying the molten mixture to a solid having segregated phases and a non-uniform microstructure, reducing the solid to a blendable particle size, and redistributing the solid phases to produce homogeneous and refined microstructure by high-energy solid state blending. The metals which generally benefit from the process are those which are immiscible in the liquid state or which form compounds of very limited solubility in the primary phase upon crystallization. Representative binary systems include Cu-Pb, In-Al, Al-Mg, Fe-Al and Mo-Fe. Other systems such as Fe-Al-Zr, Cu-Pb-Sn, Cu-Ni-Cr, W-Ni-Fe and Fe-Ti-C also can produce homogeneous structures.

In addition to the two required metals, other batch ingredients may of course be added without affecting the subsequent homogenization of the solid phases. As exemplified above, additional metal elements may be added which may either increase the amount of segregation in the rapidly solidified material or not. Other materials such as refractory oxides, carbides, nitrides, borides or intermetallics can be added for their customary purposes in the melt or later in the rapidly solidified powder prior to milling. These added materials may have melting points higher or lower than the two required metals.

In general, the batch materials are heated to above the liquidus temperature of the two metals and then rapidly solidified at preferred cooling rates of greater than $10^{2}$° C./sec. Any rapid solidification process can be used which results in cooling rates above $10^{2}$° C./sec and a segregated microstructure. We prefer rapid solidification at higher rates of at least about $10^{6}$° C./sec such as by the melt spinning process, wherein a thin stream of melt is forced through an orifice onto a moving chill surface. In this case a thin ribbon of solid material is produced. It can be reduced to a powder or other millable product by mild grinding or other convenient means. If the rapid solidification process produces a powder directly, such as by gas or liquid atomization or rapid spinning cup, no further reduction would be necessary to precede the high-energy milling step.

The rapid solidification is carried out at such a rate that the resulting structure of the solid (prior to milling) is inhomogeneous or segregated. We use these latter terms interchangeably to refer to material structure which contains discrete primary and secondary phases and wherein the second phase makes up greater than about ½% by volume of the structure. If the structure is truly homogeneous, or homogeneous enough for the intended use, there is little reason for the final redistribution (milling) step. Either the primary phase, the secondary phase or both in the rapidly solidified material can be pure end-member metals or intermediate phases (solid solutions, intermetallics, phase mixtures, etc). Depending on the composition, almost any of the phases can be either the "incorporated" phase or the matrix.

By high-energy blending or milling we mean a process which can subject the powder to high compressive forces to repeatedly deform and fracture the two-phase particles to create clean surfaces and reweld the clean surfaces together. The repeated fracture and weld refines and redistributes the segregated phases into a homogeneous structure. This step is preferably carried out in a stirred ball mill, but may take place in many other structures such as shaker mills or vibratory mills and the like. This step has the appearance of the current mechanical alloying process currently carried out on two or more separate powders, but generally requires much lower milling times due to the first-stage dispersion brought about by rapid solidification.

Products such as catalysts, bearings, electrical contacts and lead frames, among many others can be aided by the inventive process.

EXAMPLES

EXAMPLE 1

Copper/Lead Alloy

A batch composition yielding a bearing alloy of Cu-23Pb-3Sn (weight percent) was melted and rapidly solidified by melt spinning to strip of 25–75 μm in thickness. Several lead-rich zones were observed in an X-ray map of the microstructure. These structures vary from columnar near the chill wheel to discrete islands in the center of the strip, to continuous grain boundary networks at the free surface of the strip.

The strip was chopped into flakes which were then milled in a high-energy ball mill for 40 minutes at ambient temperature and argon atmosphere. Examination by Scanning Electron Microscopy of the resulting product revealed that the lead had been redistributed within the relatively harder copper matrix to form a uniform dispersion of remarkably fine particles in the copper. The individual lead-rich islands were reduced in size by an order of magnitude to about 0.3 μm. The structure was homogeneous.

EXAMPLE 2

Aluminum/Indium Alloy

Aluminum and indium are immiscible metals. If melted and poured into a mold, the metals would segregate to form a 2-layer sandwich, with aluminum going to the top. Aluminum is the harder, higher melting and lighter metal. The present method was used to uniformly distribute the softer indium in the aluminum.

A batch composition yielding an alloy of 60Al-40In (weight percent) was utilized. The raw materials were melted and rapidly solidified to a 75 μm spherical powder by the rapid-spinning cup method wherein a stream of melt is disintegrated by a rotating liquid quenchant. Segregated indium zones of about 10 μm in diameter were observed in an X-ray map of the microstructure.

The powder was then milled in a high-energy ball mill for 40 minutes at ambient temperature and argon atmosphere. Metallographic examination of the resulting product revealed that the indium had been homogeneously redistributed within the relative harder aluminum matrix to form a uniform dispersion of nominally 0.5 μm spherical regions. After milling, the aluminum matrix particles were equiaxed and the size remained about 75 μm in diameter.

We claim:

1. A process for making composite powder comprising the steps of providing a molten mixture comprising at least two metals which upon rapid solidification form a solid having segregated phases, rapidly solidifying the molten mixture to a solid having segregated phases, reducing the solid to a blendable particle size, and redistributing and refining the segregated phases to produce a homogeneous microstructure by high-energy solid state blending.

2. The process according to claim 1 for making powder wherein at least two metals are immiscible in the liquid state.

3. The process according to claim 1 for making powder wherein the rate of cooling during solidification is greater than about $10^{6}$° C./sec.

4. The process according to claim 1 for making powder wherein the high-energy solid state blending comprises ball-milling.

5. The process according to claim 1 for making powder wherein the phases are segregated to the extent that greater than ½% by volume of the solid is a second phase.

6. The process according to claim 1 for making powder wherein the molten mixture comprises at least about 2% tin, at least about 20% lead, with the balance copper.

7. The process according to claim 1 for making powder wherein the homogeneous and refined microstructure includes a minor phase within a matrix phase and wherein the minor phase is a softer material than the matrix phase material.

8. The process according to claim 3 for making powder wherein the molten mixture is rapidly solidified by a melt spinning process to a thin ribbon.

9. A process for making composite powder comprising the steps of providing a molten mixture comprising a first soft metal and a substantially larger proportion of a second, relatively harder metal, which mixture upon rapid solidification forms a solid having segregated phases, rapidly solidifying the molten mixture to a solid having a soft, minor phase segregated within a relatively harder matrix phase, reducing the solid to a blendable particle size, and redistributing and refining the segregated phases to produce a homogeneous microstructure by high-energy solid state blending, wherein the minor phase is uniformly distributed within a matrix of the second, harder phase.

* * * * *